US007344052B2

(12) United States Patent
Light

(10) Patent No.: US 7,344,052 B2
(45) Date of Patent: Mar. 18, 2008

(54) APPARATUS FOR STORING AND DISPENSING LIQUIDS

(75) Inventor: Bradley J. Light, Littleton, CO (US)

(73) Assignee: Gas-O-Haul, Incorporated, Denver, CO (US)

( * ) Notice: Subject to any disclaimer, the term of this patent is extended or adjusted under 35 U.S.C. 154(b) by 191 days.

(21) Appl. No.: 10/979,338

(22) Filed: Nov. 2, 2004

(65) Prior Publication Data

US 2006/0091154 A1 May 4, 2006

(51) Int. Cl.
*B65D 35/56* (2006.01)

(52) U.S. Cl. ..... 222/105; 222/570

(58) Field of Classification Search ..... 222/568, 222/570, 105
See application file for complete search history.

(56) References Cited

U.S. PATENT DOCUMENTS

| | | | | |
|---|---|---|---|---|
| 3,054,549 | A | 9/1962 | Humphrey | |
| 3,090,526 | A | 5/1963 | Hamilton | |
| 3,108,732 | A | 10/1963 | Curie | |
| 3,173,579 | A | 3/1965 | Curie | |
| 3,233,817 | A | 2/1966 | Casady | |
| 3,552,607 | A | 1/1971 | Edwards | |
| 4,129,236 | A * | 12/1978 | Wrycraft et al. | 222/570 |
| 4,498,609 | A * | 2/1985 | Stock | 222/571 |
| 4,572,386 | A | 2/1986 | Marcus | |
| 4,572,422 | A | 2/1986 | Heuberger et al. | |
| 4,803,053 | A * | 2/1989 | Williamson | 222/570 |
| 4,865,233 | A * | 9/1989 | Kain | 222/570 |
| 5,042,682 | A | 8/1991 | Ritter et al. | |
| 5,069,385 | A | 12/1991 | Farber | |
| 5,090,602 | A * | 2/1992 | Link | 222/159 |
| 5,092,498 | A * | 3/1992 | Willems et al. | 222/570 |
| 5,176,313 | A | 1/1993 | Curry et al. | |
| 5,195,661 | A | 3/1993 | Light | |
| 5,482,179 | A | 1/1996 | Bruhn | |
| 5,765,609 | A | 6/1998 | Dalhart et al. | |
| 5,901,887 | A * | 5/1999 | Wark | 222/568 |
| 6,223,981 | B1 | 5/2001 | Gunder | |
| 6,290,124 | B2 | 9/2001 | Andrews, Sr. et al. | |
| 6,409,220 | B1 | 6/2002 | Wing et al. | |
| 6,609,636 | B1 | 8/2003 | Petriekis et al. | |
| 6,637,623 | B2 | 10/2003 | Muise et al. | |
| RE38,377 | E | 1/2004 | Geshay | |
| 6,863,098 | B2 * | 3/2005 | Chrisco et al. | 222/568 |

* cited by examiner

*Primary Examiner*—Philippe Derakshani
(74) *Attorney, Agent, or Firm*—The Reilly Intellectual Property Law Firm, P.C.; Ellen Reilly; John E. Reilly

(57) ABSTRACT

An apparatus for storing and dispensing liquids which is made up of a rectangular container having a collapsible inner shell and a rigid outer shell, a fill neck mounted on the collapsible inner shell, the fill neck being designed to extend through an opening in the outer shell and being rigidly secured and supported to the outer shell. The fill neck includes a spout which may form a primary quick release connection with the fill neck or a secondary non-releasable connection with the fill neck to allow for single use.

16 Claims, 5 Drawing Sheets

APPARATUS FOR STORING AND DISPENSING LIQUIDS

BACKGROUND AND FIELD OF INVENTION

This invention relates to an apparatus for storing liquid; and more particularly relates to a container for storing, transporting and dispensing a liquid, specifically a flammable liquid.

Storage containers for liquids are well-known in the prior art. There are numerous variations on the formation of the container as well as placement of the dispensing spout. These variations are shown in U.S. Pat. Nos. 3,233,817, 5,176,313 and 6,290,124.

There is an unmet need for a container that is capable of storing, transporting and dispensing liquid that is easily assembled, is of sturdy construction and is also designed for a single use. This is of critical importance when transporting and dispensing flammable liquids. Many States require that portable fuel carriers be single use containers, to discourage users from storing flammable liquids in containers after a first use. In particular, it is proposed to utilize a novel fill neck support as well as a double locking spout to accomplish these results.

SUMMARY OF THE INVENTION

It is therefore an object of the present invention to provide for a novel and improved liquid dispenser which is easily stored and assembled for later use.

It is another object of the present invention to provide for a novel and improved liquid dispenser that is designed for a single use and is then disposable.

It is another object of the present invention to provide for a novel and improved liquid container that is capable of storing flammable liquid.

It is a further object of the present invention to provide for a novel and improved liquid storage container that is easy to transport when filled with a liquid.

It is a final object of the present invention to provide for a novel and improved liquid storage container that is of sturdy construction utilizing a lesser amount of plastic than other flammable liquid containers.

In accordance with the present invention, a container has been devised for use in storing liquid having an outer housing formed from a blank sheet having fold lines for folding the sheet into a rectangular box with opposite sides, top, bottom and opposite end panels, means for securing the end panels to at least one of the side top and bottom panels to define a rigid structure, a collapsible container enclosed in the housing having a fill neck extending through an opening in one of the end panels, a spout mounted on a passage in the fill neck, the spout including a filler tube and a releasable cap at one end and fill neck retainer means for securing the fill neck to one of the end panels. The spout forms a primary quick release connection with the fill neck and also forms a secondary non-releasable connection with the fill neck. The retainer means is in the form of a circular flap with a hinge and a diametrically opposed circular edge.

The above and other objects, advantages and features of the present invention will become more readily appreciated and understood from a consideration of the following detailed description of preferred and modified forms of the present invention when taken together with the accompanying drawings in which:

DETAILED DESCRIPTION OF THE INVENTION

Figure 1:
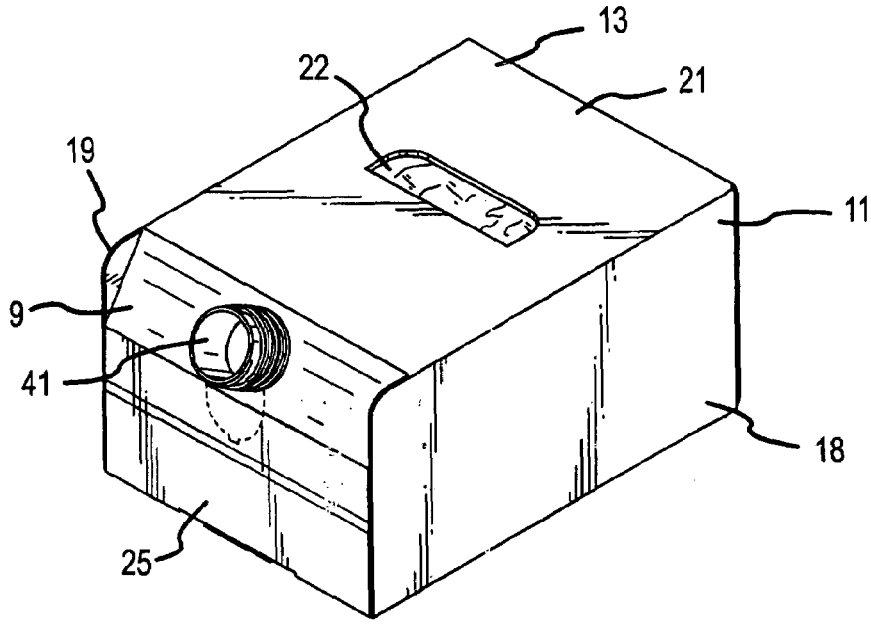
FIG. 1 is a perspective view of the container according to the present invention.
Figure 2:
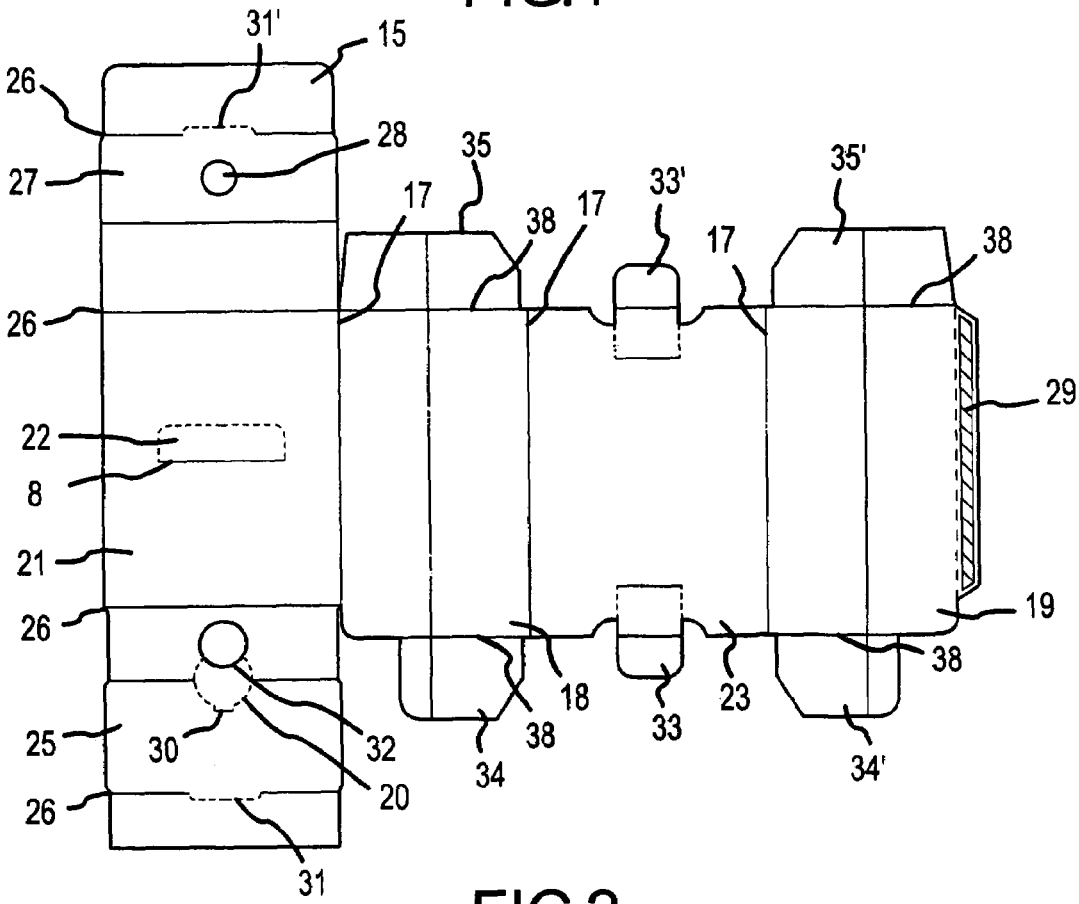
FIG. 2 is plan view of a blank used for making the container of the present invention.

Referring in more detail to FIGS. 1 to 9, there is illustrated a form of liquid container 11 which is made up of an outer housing 13 formed from a blank sheet 15 as shown in FIG. 2 having primary fold lines 17 for folding the sheet into a rectangular box having opposite sides 18, 19, a top panel 21, a bottom panel 23, front panel 25 and rear panel 27. The side panel 19 is secured to the top panel 21 with a tab 29. The front panel 25 and the rear panel 27 include securing members 31 and 31' which are connected to corresponding lower tabs 33, 33' on the bottom panel 23, forming a rectangular box. The front panel 25 includes an upper sloped or gabled member 9. The side panels 18 and 19 also include irregular shaped tabs 34, 34', 35 and 35' having secondary fold lines 38 which allow for folding of the irregular tabs 34, 34', 35 and 35' for formation of the rectangular-shaped box.

The top panel 21 and the front and rear panels 25 and 27 have tertiary fold lines 26 for folding the panels 25 and 27 into the rectangular box. The top panel 21 also contains a handle member 22 including a perforated rectangular-shaped tab 24 with a living hinge 8, shown in FIG. 3, which may be pushed inwardly and will allow for partial passage of a user's fingers in order to grip and transport the liquid container 11. This interior handle 22 provides a means for carrying the liquid container 11 while avoiding the problems associated with external handles, such as, tearing of the handle or the necessity to attach an external handle. The rear panel 27 contains a circular finger insert 28 which also aids in transporting and dispensing of the liquid. Due to the design of the container 11, a user may utilize one hand to grip the handle 22 and the circular finger insert 28. Alternatively, a user may use one hand to insert a finger in the handle 22 and the other hand to grip the circular finger insert 28. This results in a stable and easily transportable configuration which also aids in the accurate dispensing of a liquid to a target, preventing spillage.

Figure 5:
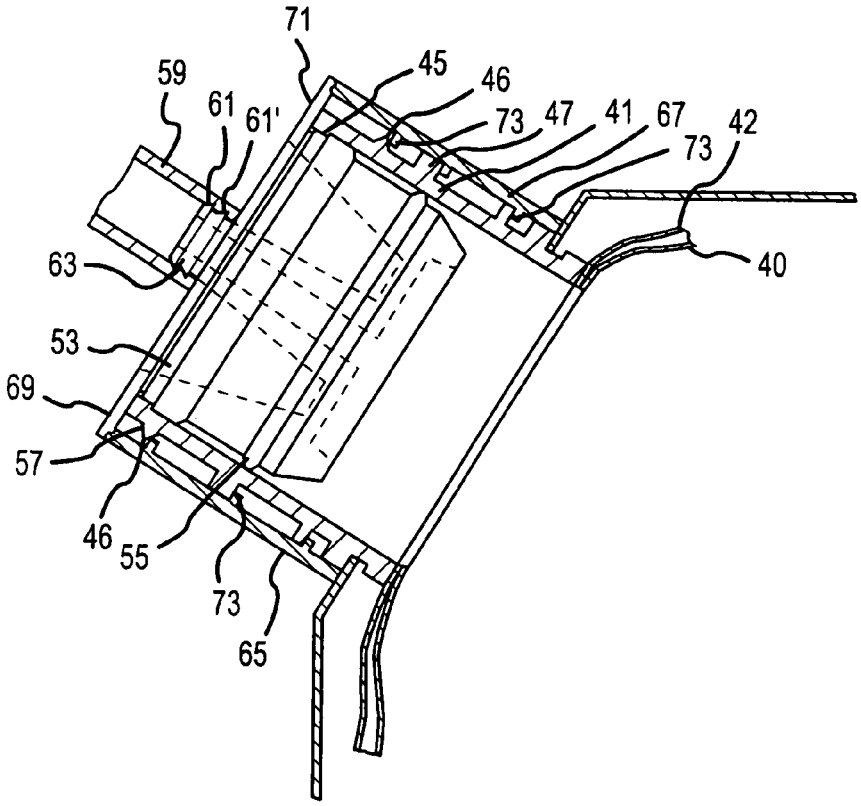
FIG. 5 shows a cross-sectional view of the fill neck and spout through lines 5-5 of FIG. 4.
Figure 6:
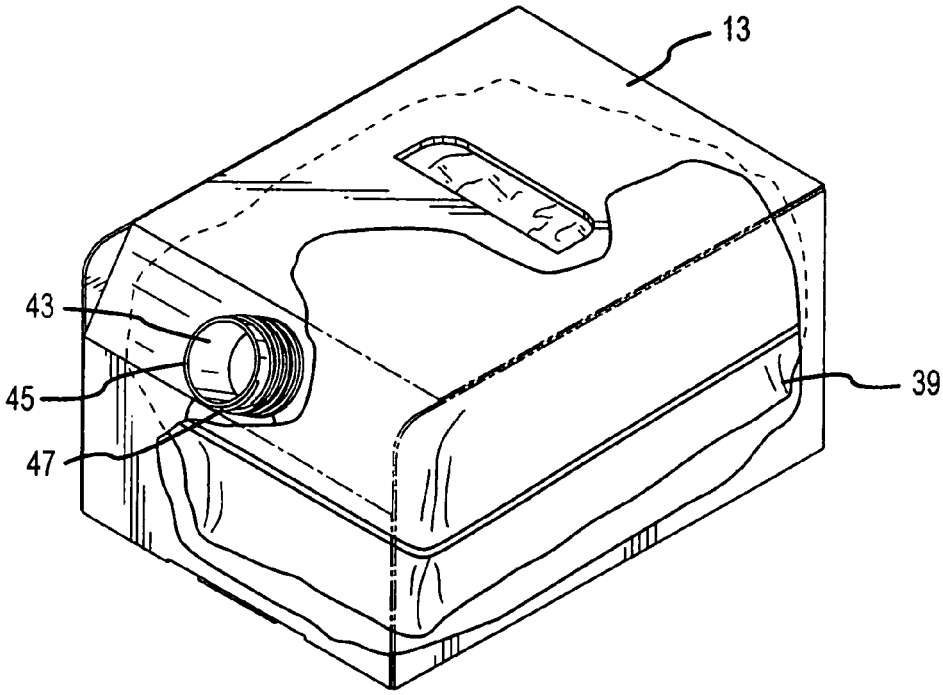
FIG. 6 is a cutaway view of the shell including a collapsible container enclosed within the shell according to the present invention.
Figure 7:
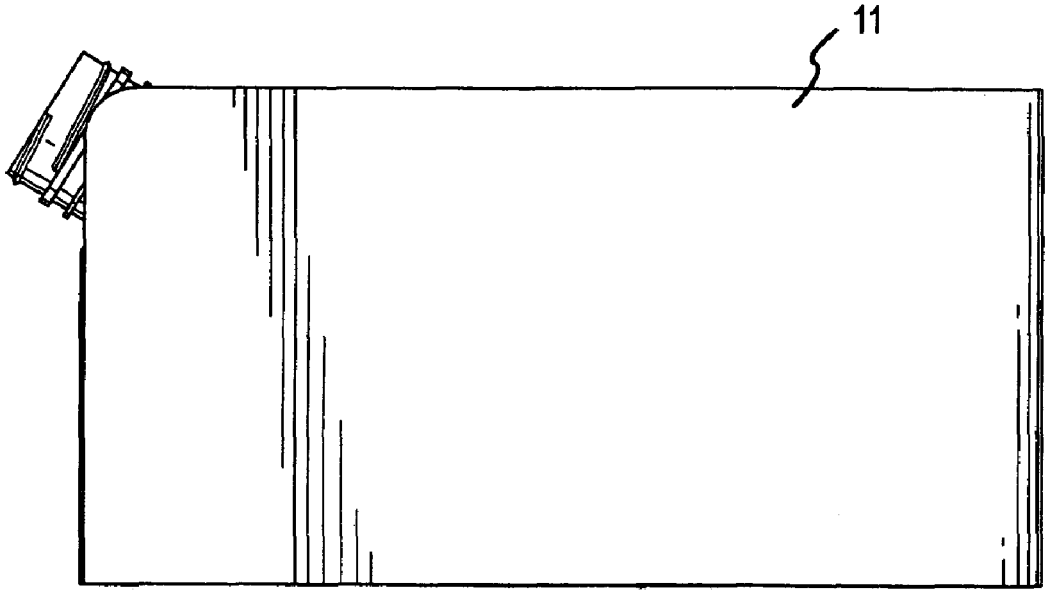
FIG. 7 is a side view of the present invention.
Figure 8:
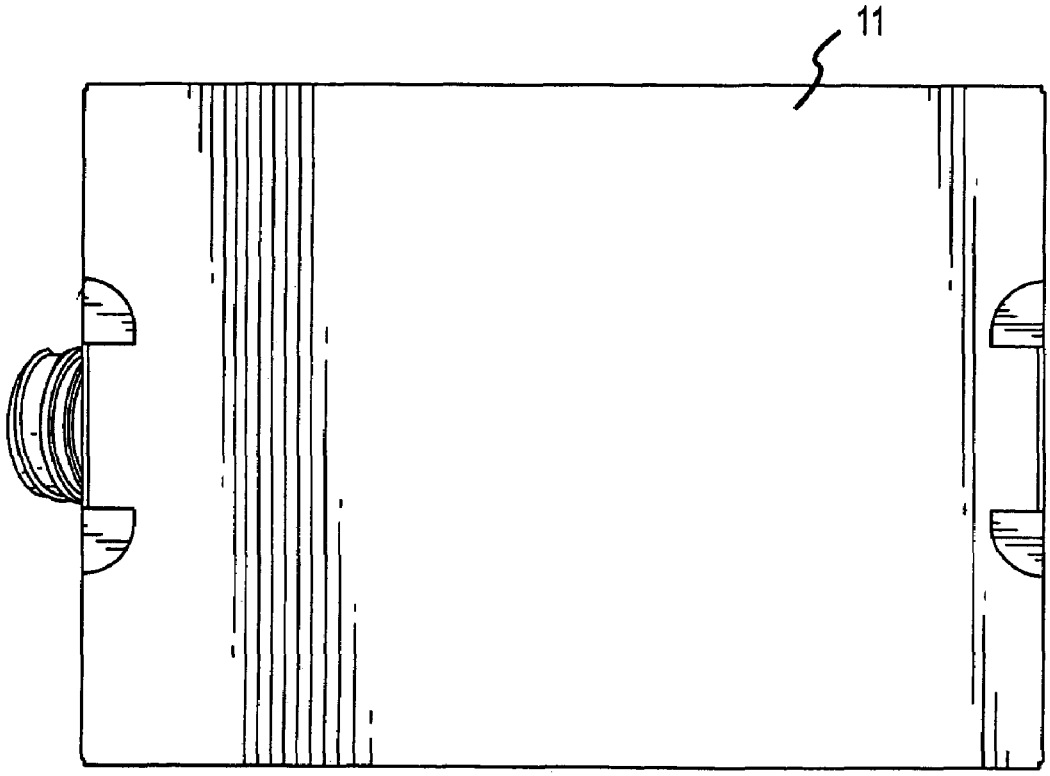
FIG. 8 is a bottom plan view of the present invention.

A collapsible container 39 as shown in FIG. 6 is enclosed within the outer housing 13 and preferably includes a double wall configuration with an inner bag 40 preferably comprising multipolymer laminate and an outer liner 42 secured to the inner bag and made up of nylon laminate. The double wall is shown in FIG. 5. The laminated material inner bag is preferably approximately 4 mm. thick and the outer liner is preferably 2 mm. of laminate. The double bag configuration prevents permeation of flammable liquids or gases into the external atmosphere. Other materials may also be used, such as, a single wall structure made up only of multipolymer laminate. The outer housing 13 is preferably 200 lb. single wall corrugated fiberboard material to give it sufficient strength and rigidity to prevent collapse of the housing 13.

Figure 3:
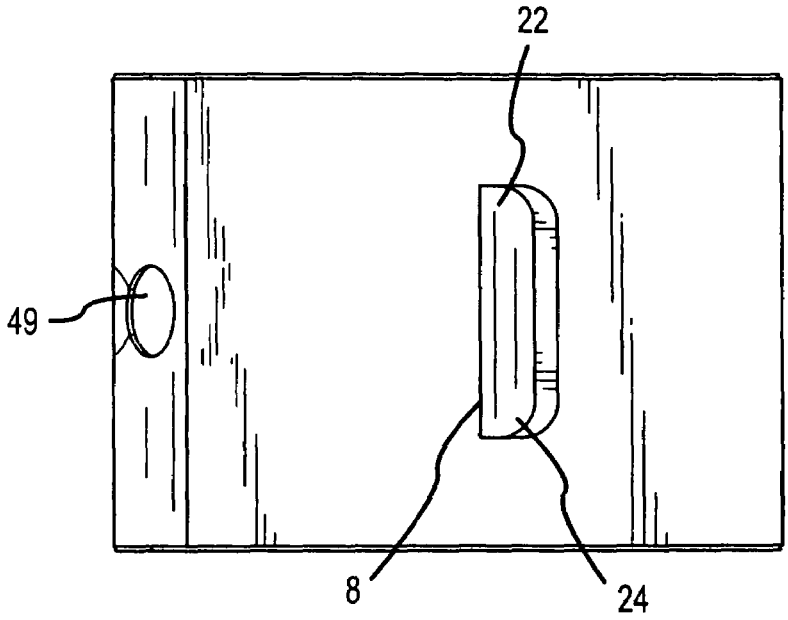
FIG. 3 is a top plan view of the container of the present invention.
Figure 4:
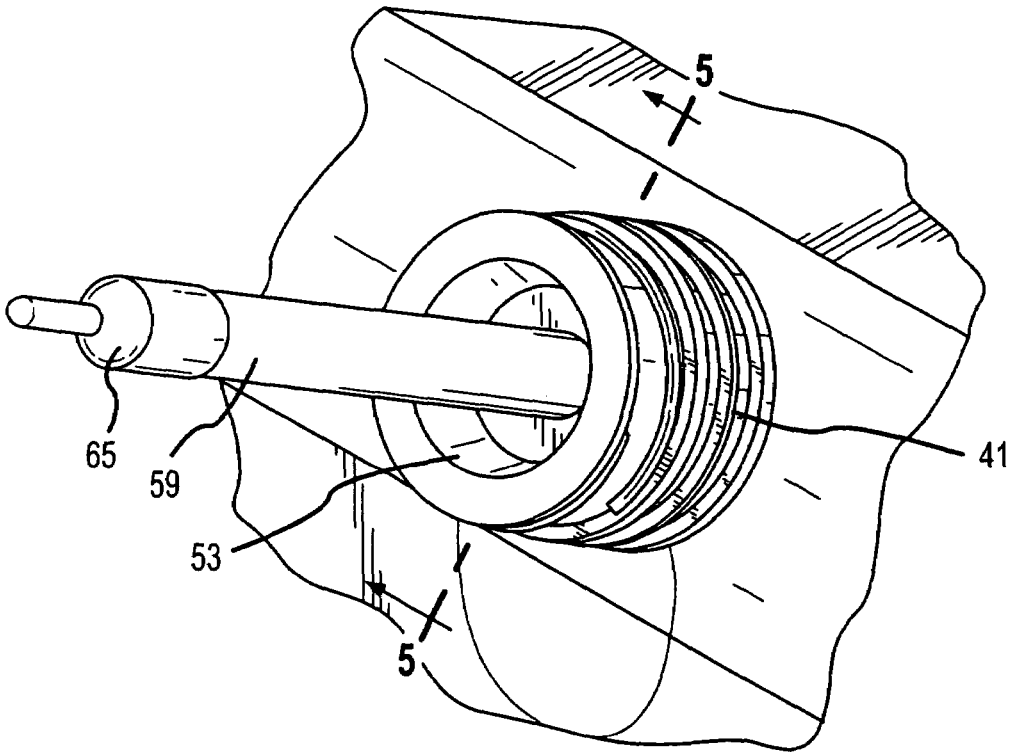
FIG. 4 shows a perspective side view of a fill neck and spout according to the present invention.
Figure 9:
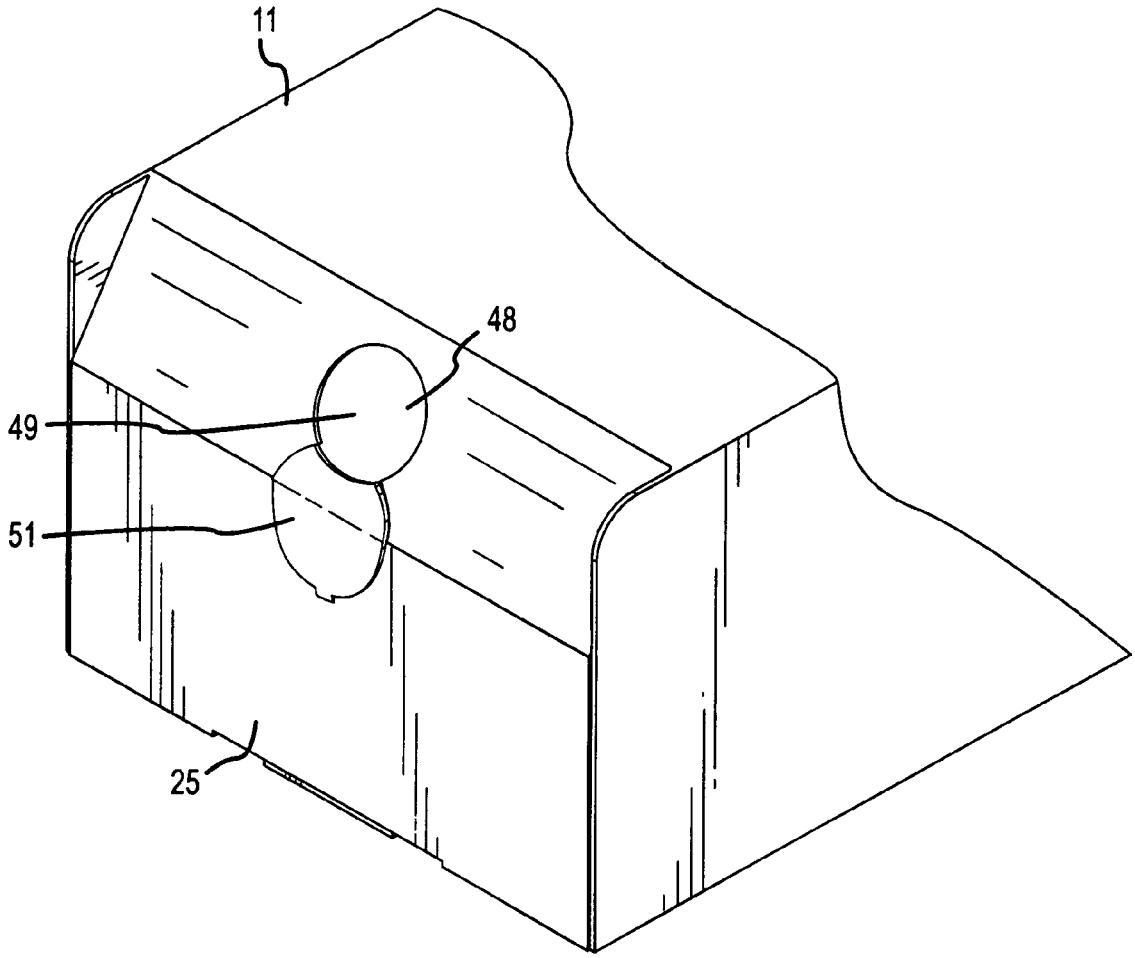
FIG. 9 is a side perspective view of the present invention without a fill neck.

A fill neck 41 is shown in FIGS. 4, 5 and 6. The fill neck 41 is circular in shape with an opening 43. The fill neck 41 is attached to the collapsible shell 39 and is designed to extend through an opening 49 in the upper sloped portion 9 of the front panel 25 of the outer housing 13. This is shown in FIGS. 3 and 9. The outer housing 13 includes a fill neck retainer 51 which releasably connects the fill neck 41 to the front panel 25. The fill neck retainer 51 is defined by a generally circular flap which is formed out of the thickness of the front panel 25 by perforations 20 which extend between a living hinge member 30 and a diametrically opposed circular edge 32 in the sloped portion 9 which partially surrounds the opening 49. In this way, the flap may be manually pushed inwardly about the hinge 30 to allow for passage of the fill neck 41 through the opening 49 without any resistance from the flap; however, once the fill neck 41 is moved up into an upper portion 48 of the opening 49, the flap is returned to its original position in the plane of the sloped portion 9 of the panel 25 so that the flap is flush with the sloped portion 9 of the panel 25. The neck retainer 51 as defined by the flap prevents lateral shifting of the fill neck, prevents the fill neck 41 from slipping back inside the outer housing 13 and also avoids the use of additional plastic supports to help retain the fill neck 41 in place. Further, since the flap is integral with the front panel 25, there are fewer components required for assembling the container 11.

Another important feature of the invention is the connection between a spout 53 and the fill neck 41. The spout 53 may be mounted on the opening or passage 43 of the fill neck 41 as demonstrated in FIGS. 4 and 5. The fill neck 41 has an internal stepped member 45 and an external beveled edge 46 and external stepped members as shown in FIGS. 5 and 6. The spout 53 has a first external beveled edge 55 and second external stepped member 57 which allow for different degrees of locking of the spout 53 into the fill neck 41. When the spout 53 is placed inside the fill neck 41 at a first position, shown in FIG. 4, the beveled edge 55 is free to slide past the internal stepped member 45 of the fill neck 41; and the beveled edge 55 can also be released from the fill neck 41 by sliding the beveled edge 55 outwardly past the shoulder or stepped member 45 so as to result in a releasable connection between the spout 53 and the fill neck 41. Typically, the releasable connection is used when storing and transporting a non-flammable liquid and the container is to be reused. When downward pressure is placed on the spout 53, the stepped member 57 of the spout 53 comes into contact with and is locked behind the internal fill neck stepped portion 45 resulting in a non-releasable connection between the spout 53 and the fill neck 41. As a result of the non-releasable connection, once the spout 53 is placed in the second position, which is shown in FIG. 5, the spout 53 may not be removed. The liquid container then becomes a single use container which is important when using flammable liquids. The collapsible shell 39 may be filled with a flammable liquid, such as, gasoline, propane or the like and the spout 53 is connected with the fill neck 41 in the second position. This results in a non-releasable attachment between the fill neck 41 and the spout 53. This allows for accurate and safe dispensing of the flammable liquid into a target. Once the flammable liquid is dispensed from the collapsible shell 39, the spout 53 may not be removed and the container 11 must be disposed of.

The spout 53 is formed from a low density polyethylene and has a filler tube 59 attached which is preferably made of a clear plastic material, such as, tygon. This allows for unobstructed viewing of the liquid passing through the tube 59 and provides a means for viewing if a target fuel tank or target dispensing member is full. The tube 59 is attached to the spout 53 with external beveled or ridged members 61, 61' located on a protrusion 63 from the spout 53. A cap 65 on the end of the tube 59 as shown in FIG. 4 is made of low density polyethylene. The cap 65 is easily removed from the spout 53 to prevent spilling of the liquid from the container 11 during transporting.

FIG. 5 demonstrates an alternate form of a spout with a cover 71 which includes the spout 53 as described previously, having side members 65 and 67 which are secured along their upper portions to a top member 69 of the cover 71. This forms an external spout cover 71 having internal stepped members which correspond to the external beveled edge 46 and the external stepped members 47 of the fill neck 41. The external spout cover 71 is permanently secured to the spout member 53 and allows for rotation of the spout 53 into a releasable connection with the fill neck 41 as previously described as well as the non-releasable connection with the fill neck 41. The invention is capable of forming a releasable and non-releasable connection with the fill neck 41 using the form of invention shown in FIG. 4 as well as forming a releasable and non-releasable connection with the fill neck 41 using the alternate form of invention, the spout cover 71, as shown in FIG. 5.

In use, the blank sheet 15 is assembled as previously described forming a rectangular box. The collapsible container 39 is enclosed within the outer housing 13 and the fill neck 41 which is attached to the collapsible container 39 is advanced through the opening 49 in the front panel 25 of the housing 13. This is accomplished by adjusting the position of the flap of the fill neck retainer 51, either inwardly or outwardly, to allow for passage of the fill neck 41. The fill neck 41 is then moved up into the upper portion 48 of the opening 49 and is locked into place by replacing the fill neck retainer 51 into its original position.

A user may then transport the container 11 by pushing the tab 24 inwardly which then forms a handle or gripping member 22. There is also the circular finger insert 28 which aids in transporting the carrier 11. The container 11 may then be filled with a liquid, flammable or non-flammable, and the spout 53 may be mounted on the opening 43 of the fill neck 41 and placed in a first position. If a user desires to dispense a flammable liquid from the spout 53, it is recommended that the spout 53 be placed in the second position by applying a downward force to the spout 53 causing the spout to be non-releasably secured within the fill neck 41. Once the liquid is dispensed, the container 11 may be disposed of.

Alternatively, the cover 71 may be used which allows a user to apply a slight rotational force on the spout cover 71 to accomplish the releasable and non-releasable connection with the fill neck 41 as previously described.

It is therefore to be understood that while preferred forms of invention are herein set forth and described, the above and other modifications may be made therein without departing from the spirit and scope of the invention as defined by the appended claims and reasonable equivalents thereof.

I claim:

1. A liquid storage device comprising:

an outer housing formed from a blank sheet having fold lines for folding said sheet into a rectangular box having opposite sides, top, bottom and opposite end panels; means for securing said end panels to at least one said side, top and bottom panels to define a rigid structure;

a collapsible container enclosed in said housing having a fill neck extending through an opening in an upper sloped portion of one of said end panels, wherein said fill neck has an internal stepped member, an external stepped member, and an external beveled edge;

a spout mounted on a passage in said fill neck, said spout including a filler tube and a releasable cap at one end thereof, wherein said spout has an external beveled edge and an axially spaced external stepped member complementary to said internal and external stepped members and said external beveled edge of said fill neck wherein said spout and said fill neck are adjustably connected to one another at different degrees of complementary fitting and locking of said spout into said fill neck; and a fill neck retainer member at least partially disposed on said upper sloped portion including a circular edge engageable with said fill neck for securing said fill neck to said upper sloped portion.

2. The liquid storage device according to claim one wherein said filler tube is formed from a clear plastic material.

3. The liquid storage device according to claim 1 wherein said spout forms a primary quick release connection with said fill neck.

4. The liquid storage device according to claim 1 wherein said spout includes at least one external stepped member complementary to at least one internal stepped member of said fill neck.

5. The liquid storage device according to claim 4 wherein said spout forms a secondary non-releasable connection with said fill neck.

6. The liquid storage device according to claim 1 wherein said fill neck includes at least one external stepped member and at least one beveled edge member.

7. The liquid storage device according to claim 6 wherein an external cap has a diameter sized to fit around said fill neck corresponding with said external stepped members and said external beveled edge member.

8. The liquid storage device according to claim 1 wherein said retainer member includes a circular flap member with a hinge diametrically opposed to said circular edge.

9. A container for transporting a flammable liquid, comprising:

a rectangular shell having an inclined upper front panel portion;

said shell enclosing a collapsible member having a single opening sealed around a fill neck;

a spout mounted on a passage in said fill neck; and a fill neck support member, located on said inclined upper front panel portion, in the form of a circular flap having a circular edge engageable with said fill neck and a hinge diametrically opposed to said edge panel, wherein said spout includes an external beveled edge and an axially spaced stepped member engageable with an internal stepped portion on said fill neck.

10. The container according to claim 9 wherein said fill neck includes a primary quick release connection with said spout member.

11. The container according to claim 9 wherein said fill neck includes a secondary non-releasable connection with said spout member.

12. The container according to claim 9 wherein said spout includes a base and a clear tube, said base including ridge members forming a secure connection between said base and said tube.

13. A rectangular flammable liquid container formed from a blank sheet of material, comprising:

a top panel having at least one perforated handle member;

opposite sides, a bottom and opposite end panels joined together to define a rectangular enclosure including securing members at said end panels;

a collapsible enclosure member in said container having a fill neck extending outwardly from such collapsible enclosure member; and a fill neck support member partially disposed on an upper inclined panel portion on one of said end panels, said support member defined by a generally circular flap hinged to said end panel and a diametrically opposed circular edge.

14. The liquid container according to claim 13 wherein said fill neck support member includes said flap being pivotal between a released position extending away from said inclined end panel and a locking position in the plane of said inclined end panel.

15. The liquid container according to claim 13 wherein said collapsible member includes non-flammable components.

16. A liquid storage device comprising:

an outer housing formed from a blank sheet having fold lines for folding said sheet into a rectangular box having opposite sides, top, bottom and opposite end panels;

means for securing said end panels to at least one said side, top and bottom panels to define a rigid structure;

a collapsible container, enclosed in said housing having a fill neck extending through an opening in an upper inclined panel located on one of said end panels;

a spout mounted on a passage in said fill neck, said spout including a filler tube and a releasable cap at one end thereof;

a fill neck support member having a generally circular edge movable into alignment with an outer surrounding edge of said opening in said upper inclined panel; and said spout including an external beveled edge and an external stepped member complementary to an internal stepped member and an external beveled edge of said fill neck.

* * * * *